United States Patent [19]

Willis

[11] 4,342,198

[45] Aug. 3, 1982

[54] GAS TURBINE ENGINE FUEL INJECTORS

[75] Inventor: Jeffrey D. Willis, Coventry, England

[73] Assignee: Rolls-Royce Limited, London, England

[21] Appl. No.: 169,431

[22] Filed: Jul. 16, 1980

[30] Foreign Application Priority Data

Aug. 1, 1979 [GB] United Kingdom ..... 7926835

[51] Int. Cl.[3] ..... F23R 3/36; F23R 3/38

[52] U.S. Cl. ..... 60/737; 60/742; 60/748; 239/400; 239/406

[58] Field of Search ..... 60/742, 740, 748, 737; 239/400, 405, 406, 399

[56] References Cited

U.S. PATENT DOCUMENTS

| | | | |
|---|---|---|---|
| 2,044,296 | 6/1936 | Hardgrove | 239/400 |
| 3,285,007 | 11/1966 | Carlisle et al. | 60/748 |
| 3,684,186 | 8/1972 | Helmrich | 239/400 |
| 3,690,093 | 9/1972 | Carlisle | 239/400 |
| 3,788,067 | 1/1974 | Carlisle et al. | 60/742 |

OTHER PUBLICATIONS

German Publication DE-OS-NO.2910464, Sep. 20, 1979 (copy of corresponding U.S. Ser. No. 12,122, filed Feb. 14, 1979, submitted).

German Publication DE-OS-NO.2060158, Jun. 8, 1972 (copy of British specification No. 1,284,440, Aug. 9, 1972, submitted).

French Publication No. 2323013, Apr. 1, 1977.

*Primary Examiner*—Robert E. Garrett

*Attorney, Agent, or Firm*—Cushman, Darby & Cushman

[57] ABSTRACT

A gas turbine engine fuel injector has distinct and separate flow paths for liquid and gaseous fuel which each terminate in outlets of decreasing cross-sectional area in order to prevent combustion products from the flame tube or tubes of the engine from flowing back into the injector, the separate fuel flow paths preventing fuel from migrating from one path to the other. Compressor delivery air is also arranged to flow through the fuel outlets and some mixing of fuel and air takes in the outlets before the fuel enters the flame tube.

The fuel injector is formed in two separate and co-operating parts, a fuel feed arm attached to the engine casing and readily removable through a relatively small access aperture in the casing and a fuel and air inlet means which is attached to the head of the flame tube and defines the fuel and air inlets into the flame tube.

The fuel injector is designed to operate on a wide calorific value range of both liquid and gaseous fuels and water injection means are also incorporated to reduce $NO_x$ emissions.

10 Claims, 3 Drawing Figures

GAS TURBINE ENGINE FUEL INJECTORS

Figure 1:
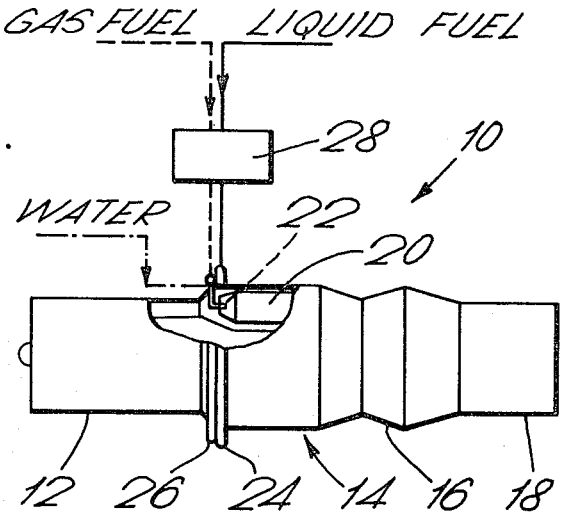

This invention relates to gas turbine engine fuel injectors and is particularly concerned with fuel injectors of the dual fuel type which are adapted to burn a range of liquid and gaseous fuels having a large variation in calorific value. For example in the case of gaseous fuels the calorific value of the gas to be burnt may vary from 100 British Thermal Units/standard cubic foot (BTU/scf) in the case of a coal derived gas having a large proportion of inerts, to propane ($C_3H_8$) which has a calorific value of 2316 BTU/scf. In the case of liquid fuels, the fuels may comprise, condensates, distillates, methanol, ethanol and diesel.

Particularly in the case of gaseous fuels the large range of calorific values means that in order to maintain a constant heat output/unit time over the whole range of fuels the injector must be able to cope with a large variation in mass flow. This will require a relatively large fuel injector and associated swirlers and inlets in the flame tube or tubes of the engine. However, the injector must also be readily removable from the in use position through an opening in the engine casing which is not excessively large.

The fuel injector must be able to operate without the danger of combustion products from the flame tube or tubes flowing back into the fuel duct or ducts of the injector and the fuel injector must also be arranged so that fuel cannot migrate between the liquid and gaseous fuel ducts of the injector.

The present invention provides a gas turbine engine dual fuel injector comprising a structure defining separate gaseous fuel and liquid fuel flow paths, the gaseous fuel flow path including a first annular gas duct in communication with a second annular gas duct, the second annular gas duct decreasing in cross-sectional area in the direction of flow therethrough and including air swirling means, the liquid fuel flow path including primary liquid fuel nozzles and a main liquid fuel nozzle and an annular liquid fuel duct downstream of said liquid fuel nozzles which decreases in cross-sectional area in the direction of flow therethrough the primary and main liquid fuel nozzles being arranged to inject liquid fuel into an air flow passage located upstream of the annular liquid fuel duct the annular liquid fuel duct being located inwardly of the second annular gas duct, both the annular liquid fuel duct and the second annular gas duct being arranged in use to receive a flow of internally fed compressed air.

In a preferred arrangement, the fuel injector structure is made in two main cooperating but separate parts, a fuel feed arm which receives the liquid and gaseous fuels and which includes the first annular gas duct and the primary and main liquid fuel nozzles and fuel and air inlet means which is attached to the head of the flame tube, the fuel and air inlet means comprising the second annular gas duct and the annular liquid fuel duct.

Means for injecting water into the liquid fuel duct may also be provided.

Figure 2:
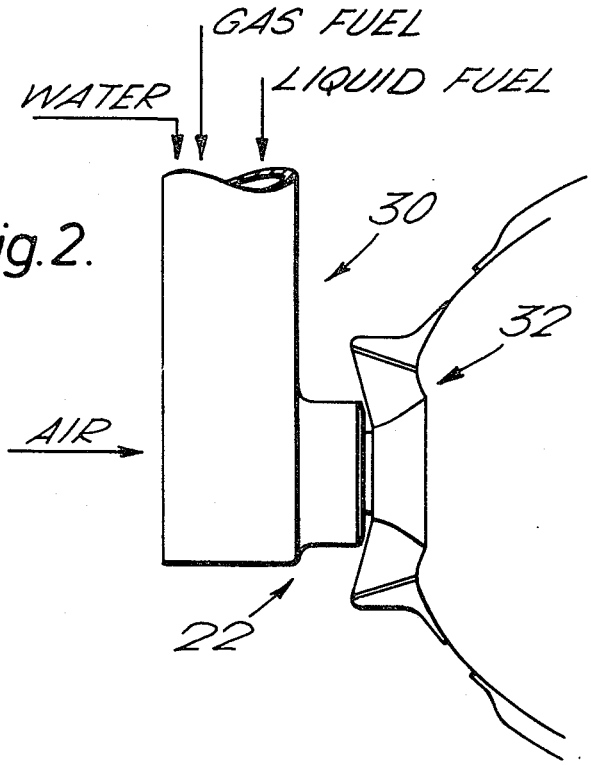
Figure 3:
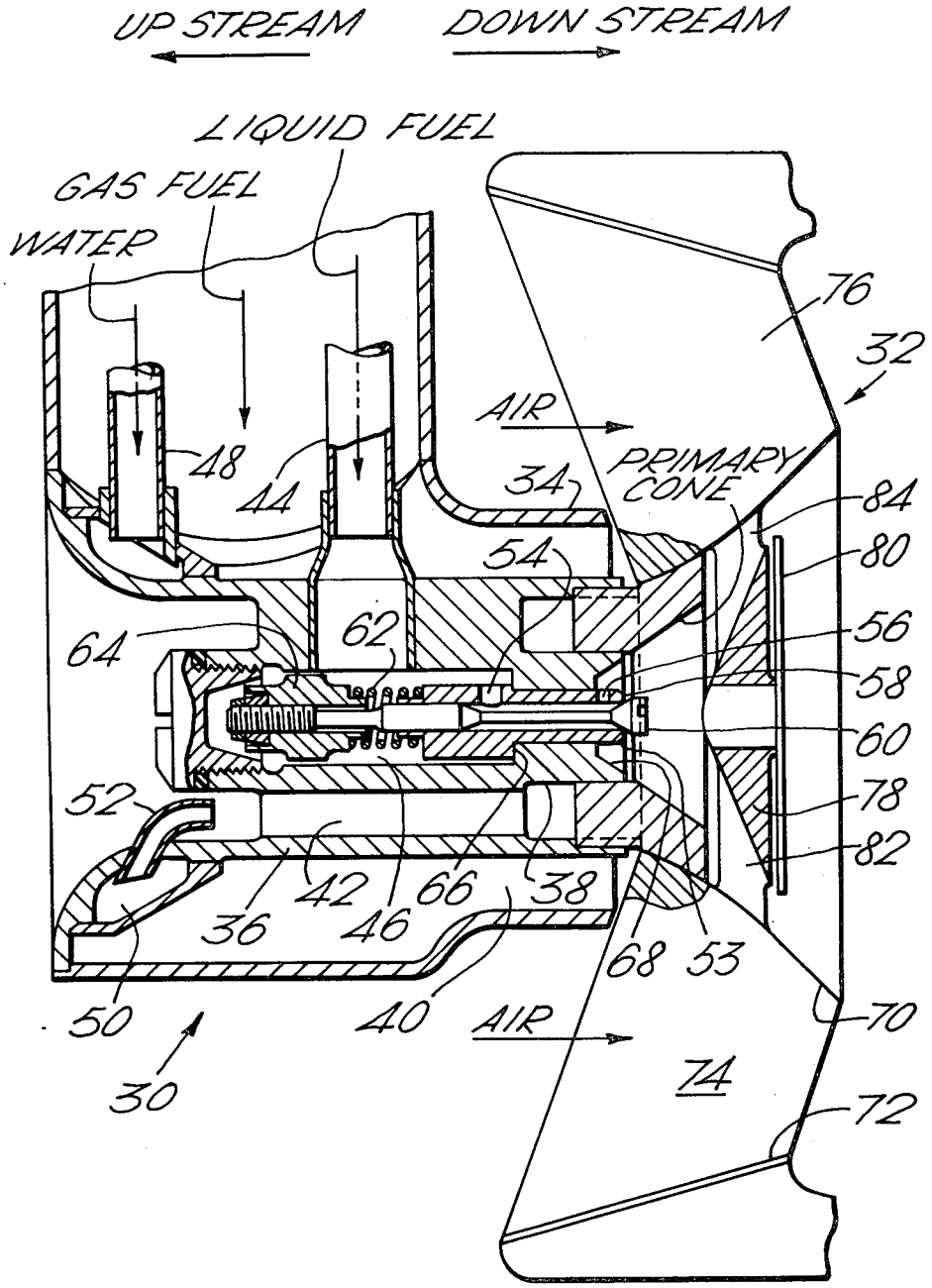

The present invention will now be more particularly described with reference to the accompanying drawings in which:

FIG. 1 shows a gas turbine engine incorporating one form of fuel injector according to the present invention, FIG. 2 is a view of a larger scale of the fuel injector shown in FIG. 1 and, FIG. 3 is a detailed view of the fuel injector shown in FIG. 2.

Referring to the drawings, a gas turbine engine power plant 10 comprises in flow series one or more compressors 12, combustion equipment 14 and one or more turbines 16, which drive the or all the compressors 12, the turbine exhaust gases being directed to atmosphere via a power turbine 18. A load (not shown) such as a pump or generator is driven by the power turbine.

The combustion equipment 14 comprises a plurality of angularly spaced apart flame tubes 20, each of the flame tubes being provided at its upstream end with a fuel injector 22.

Each fuel injector 22 can receive liquid or gaseous fuel from respective liquid and gaseous fuel manifolds 24, 26 which themselves are connected to a dual fuel control unit 28. The supply of liquid or gaseous fuel either separately or simultaneously and the flow rate of either fuel is determined by the unit 28 in response to one or more operating parameters, e.g. load.

Referring more particularly to FIGS. 2 and 3, each fuel injector 22 comprises a fuel feed arm 30 and a cooperating but separate fuel and air inlet means 32 which is attached to the upstream end of each flame tube 20. The fuel feed arm 30 is removable from the engine through a relatively small access opening (not shown) in the engine casing and the fuel and air inlet means is mounted independently of the arm to avoid the need for an excessively large access opening in the casing.

The fuel feed arm 30 comprises a casing 34, a first housing 36 and a second housing 38 supported from the first housing, the casing 34 and housing 36 defining between them a first annular gas duct 40 and the housings 36, 38 defining between them an annular air flow duct 42.

Gaseous fuel is supplied from the manifold 26 to the interior of the casing 34 and thence to the duct 40 and a liquid fuel supply pipe 44 connected to the manifold 24 is located inside the casing and leads to a chamber 46 inside the housing 38.

A water supply pipe 48 is also located inside the casing 34 and leads to a manifold 50 having outlets 52 so that water can be injected into the annular air flow passage 42.

A sleeve 53 extending into the chamber 46 is mounted in a central bore in the housing 38 and has a fuel inlet 54, a number of primary fuel nozzles 56 and a main fuel nozzle 58 which is closed off by a valve 60. A spring 62 held in position by a retaining block 64 holds the valve 60 in the closed position and the sleeve is held in position by the liquid fuel pressure which forces the sleeve against a shoulder 66 in the housing 38.

The downstream end of the housing 38 has a primary fuel deflecting surface 68 against which the primary fuel from the nozzles 56 is arranged to impinge, the surface 68 being part conical so that the primary fuel leaves the housing in a conical sheet.

The fuel and air inlet means 32 comprise inner and outer circular members 70 and 72 respectively which between them support a number of equi-spaced swirler vanes 74 and define a second annular gas duct 76 which decreases in cross-sectional area in the downstream direction.

A cone shaped baffle 78 having a heat shield 80 is located centrally in the ring 70 by a number of radially extending arms 82, the baffle and the ring 70 defining between them an annular liquid fuel duct 84. An upstream extension of the ring 70 mates with an undercut formed in the housing 36.

The combination of the fuel feed arm 30 with the fuel and air inlet means 32 provides the fuel injector 22 with two distinct and separate fuel paths, one for the gaseous fuel comprising the first and second annular gas ducts 40 and 76, compressed air from the compressor 12 also flowing through the duct 76 and one for the liquid fuel comprising the annular liquid fuel duct 84.

When the engine 10 is operating on gaseous fuel only, the fuel flows into the interior of the casing 34, along the duct 40 and into the duct 76 adjacent the inner member 70. Compressor delivery air direct from the compressor 12 flows both into the duct 84 via the duct 42, and into the duct 76. The fuel is partially mixed with air in the duct 76 and the partially mixed gas and air is sandwiched between two air flows as it leaves the duct 76. The fuel and air is rigorously swirled by the action of the swirl vanes 74 and the swirling mixture is impinged upon by the air issuing from the duct 84 causing further mixing between the fuel and air close to the head of the flame tube.

The fuel injector is designed to burn gaseous fuels having a large range of calorific values, for example, from a coal derived gas with large quantities of inerts which has a calorific value of about 100 BTU's/scf to propane which has a calorific value of 2316 BTU's/scf.

When the fuel injector is operating only on liquid fuel, the liquid fuel flows through the supply duct 44 to the chamber 46, through the inlet 54 and out of the primary nozzles 56. The fuel impinges upon the surface 68 and the cone of fuel thus formed is sprayed into the duct 84 and the air stream from the duct 40. When the fuel pressure reaches a certain predetermined value, the force on the block 64 will be sufficient to overcome the force of the spring 60 and the valve 60 will open allowing fuel to flow out of the main fuel nozzle 58 as well as from the primary fuel nozzles. The fuel flows into the air stream flowing along the ducts 40 and 84 and some fuel and air mixing takes place in the duct 84. The partially mixed fuel and air flow out of the duct 84 and are mixed further with the swirling mass of air issuing from the swirl vanes 74, close the head of the flame tube. The fuel injector is designed to burn a range of liquid fuels including condensates such as natural gas liquid, liquid propane, methanol, ethanol and diesel.

In order to reduce the formation of $NO_x$ particularly when burning liquid fuels, water can be injected into the air stream flowing through the duct 42 from the water inlets 52 to reduce the combustion temperature, thereby reducing the rate of $NO_x$ production.

The water is dispersed throughout the combustion zone of the flame tube because it is rapidly atomised in the duct 42 where it also pre-mixed with liquid fuel and its ejection from the duct ensures that it is substantially evenly dispersed in the flame tube as compared to some water injection arrangements in which the water is injected through the swirl vanes and some water is lost downstream before it can be used to quench in the combustion zone.

The fuel injector according to the invention comprises the following advantageous features:

the separate and distinct passages for the liquid and gaseous fuels prevents fuel from one passage entering the other fuel passage the combustion products are prevented from flowing back into the fuel passages because each of the ducts 76, 84 decreases in cross-sectional area in the direction of flow and acts as a venturi. The flow of air through the ducts 76, 84 thereby preventing any reverse flow whichever fuel is being burnt.

the injector is designed to accept large variations in the mass flow rates of gaseous fuels which are required to produce a constant heat output/unit time for wide calorific value range of fuels. The velocity of the gaseous fuels through the injector will therefore vary according to density and calorific value and the injector is designed so that the compressor delivery flow will always dominate the fuel flow and the gas fuel will be forced to follow a path through the duct 76.

the injector is formed in two main parts, the fuel feed arm and the fuel and air inlet means, so that the fuel feed arm can be removed through a relatively small access aperture in the engine casing while the fuel and air inlet means remains attached to the flame tube both the liquid and gaseous fuels can be at least partially mixed with compressor delivery air before entering the flame tube the manner in which the $NO_x$ reducing water is injected into the air flow which then mixed with the liquid fuel ensures that substantially all the water is entrained into the recirculating flow in the flame tube.

The retaining block 64 may be provided with a number of raised lands which engage the central bore in the housing 38, and the lands are so sized that there is a small clearance between the bore and the lands to allow liquid fuel to fill the space on the upstream side of the retaining block 64. The presence of the liquid fuel in this space acts as a damper on any oscillation of the sleeve 53 which may occur due to sudden changes in fuel demand.

I claim:

1. A gas turbine engine dual fuel injector comprising a structure defining separate gaseous and liquid fuel flow paths, the gaseous fuel flow path including a first annular gas duct in communication with a second annular gas duct, the second annular gas duct decreasing in cross-sectional area in the direction of flow therethrough and including air swirling means, the liquid fuel flow path including primary liquid fuel nozzles and a main liquid fuel nozzle and an annular liquid fuel duct downstream of said liquid fuel nozzles which decreases in cross-sectional area in the direction of flow therethrough, the primary and main liquid fuel nozzles being arranged to inject liquid fuel into air from an air flow passage located upstream of the annular liquid fuel duct, the annular liquid fuel duct being located inwardly of the second annular gas duct, both the annular liquid fuel duct and the second annular gas duct being arranged in use to receive a flow of compressed air.

2. A fuel injector as claimed in claim 1 in which the fuel injector structure comprises a fuel feed arm and a co-operating fuel and air inlet means, the fuel feed arm including a casing and a first housing which between them define the first annular gas duct, and a second housing which with the first housing defines the annular air flow passage, the fuel and air inlet means including the second annular gas duct and the annular liquid fuel duct, being attached to the upstream end of the gas turbine engine combustion equipment.

3. A fuel injector as claimed in claim 2 in which the casing includes a gaseous fuel supply duct in communication with the first annular gas duct and a liquid fuel supply duct in communication with the primary and main liquid fuel nozzles.

4. A fuel injector as claimed in claim 2 in which the first and second housings between them define an annular air passage for the through flow of compressed air.

5. A fuel injector as claimed in claim 2 in which the second housing includes a duct in communication with a liquid fuel supply and terminating in a plurality of radially directed primary fuel nozzles and a central main fuel nozzle, the main fuel nozzle being closed by a spring loaded valve.

6. A fuel injector as claimed in claim 5 in which the said duct is provided in a valve assembly mounted in a chamber the second housing, the valve assembly comprising a sleeve having a fuel inlet, the primary and main fuel nozzles and the spring loaded valve, the stem of which is located in the sleeve, the valve being held in position by a spring retaining means, the valve being operable by liquid fuel pressure in the chamber acting on the retaining means.

7. A fuel injector as claimed in any one of the preceding claims 2 to 6 in which the second housing has a primary fuel deflecting surface against which the primary liquid fuel is arranged to impinge.

8. A fuel injector as claimed in any one of the preceding claims 2 to 6 having a water manifold and water inlet means arranged to inject water into the annular air flow passage.

9. A fuel injector as claimed in claim 2 in which the fuel and air inlet means comprise a row of spaced apart swirl vanes supported between inner and outer circular members, said inner and outer members defining the second annular gas duct, the second annular gas duct being arranged to receive in use a flow of compressed air and a flow of gaseous fuel from the first annular duct upstream of said vanes and adjacent the said inner member.

10. A fuel injector as claimed in claim 9 in which the annular liquid fuel duct is defined by a baffle member supported centrally in the circular inner member.

* * * * *